US006510979B2

(12) United States Patent
Häggman et al.

(10) Patent No.: US 6,510,979 B2
(45) Date of Patent: Jan. 28, 2003

(54) CONTAINER SHAPED AS AN UPWARDLY TAPERING CONE

(75) Inventors: Jaako Häggman, Helsinki (FI); Ensio Mykkänen, Valkeakoski (FI); Hannu Aaltonen, Valkeakoski (FI)

(73) Assignee: UPM-Kymmene Corporation, Valkeakoski (FI)

( * ) Notice: Subject to any disclaimer, the term of this patent is extended or adjusted under 35 U.S.C. 154(b) by 0 days.

(21) Appl. No.: 09/974,599

(22) Filed: Oct. 10, 2001

(65) Prior Publication Data

US 2002/0014520 A1 Feb. 7, 2002

Related U.S. Application Data

(62) Division of application No. 09/716,635, filed on Nov. 20, 2000, which is a continuation of application No. PCT/FI99/00400, filed on May 12, 1999.

(30) Foreign Application Priority Data

May 29, 1998 (FI) ..... 981219

(51) Int. Cl.[7] ..... B65D 3/06; B65D 3/10

(52) U.S. Cl. ..... 229/5.5; 229/4.5

(58) Field of Search ..... 229/4.5, 5.5, 5.6, 229/5.7, 5.8

(56) References Cited

U.S. PATENT DOCUMENTS

| | | | | | |
|---|---|---|---|---|---|
| 3,583,624 | A | * | 6/1971 | Peacock | 229/5.5 |
| 4,373,646 | A | * | 2/1983 | MacEwen | 229/4.5 |
| 5,620,135 | A | * | 4/1997 | Stahlecker et al. | 229/4.5 |
| 5,622,308 | A | * | 4/1997 | Ito et al. | 229/5.5 |

* cited by examiner

*Primary Examiner*—Gary E. Elkins
(74) *Attorney, Agent, or Firm*—Fitch, Even, Tabin & Flannery

(57) ABSTRACT

The method for forming a container that comprises the following stages: the forming of the sidewall blank from a blank by wrapping it in a form that is closed in its horizontal section and by seaming its opposite edges together; the sealing of the sidewall blank at one end with a lid member, which is equipped with a discharge hole; the sealing of the sidewall blank at the other end with a bottom member; and the filling of the container. At first the lid member, the discharge hole of which is completely sealed with an openable closing member, is inserted into the end of the sidewall blank. Thereafter the container is filled through the end of the sidewall blank that was left open, and the container is sealed to form a tight container by sealing the end that was left open with the bottom member.

1 Claim, 4 Drawing Sheets

CONTAINER SHAPED AS AN UPWARDLY TAPERING CONE

This is a division, of prior application Ser. No. 09/716,635, filed Nov. 20, 2000, which is a continuation of PCT/F199/00400, filed May 12 1999, designating the U.S., which is hereby incorporated herein by reference in its entirety.

The present invention relates to a method for forming a single-portion package. The present invention also relates to a packaging machine. The present invention also relates to a blank web and a filled container.

The prior art in the food industry is to use food containers which have a closed form in horizontal cross-section, for the packing of liquid. foodstuffs. The said containers are formed by wrapping the blank to form a closed sidewall blank of horizontal cross-section and by closing both its open ends with an end member. One end member, the lid member, comprises a discharge hole which is opened to empty the contents of the container, and for this reason the said member is equipped with e.g. a closing flap, which when pulled off, reveals the hole. In connection with the production of the container, the container is filled aseptically with the contents through the open discharge hole, after which the discharge hole is sealed tightly. After this the container is ready for transportation and sale.

The stages described above are automated, and there are many known packaging machines that comprise a container-forming unit and a filling unit. In the container-forming unit the container closed with an end member as described above is formed, and in the filling unit the filling takes place through the discharge hole and the closing of the discharge hole is performed with a detachable closing element. For example European Patent 456011 shows and describes a container-forming unit of a packaging machine as described above. The end member, which may already have a closing flap adjacent to the filling hole, is inserted into the end of the sidewall blank and seamed onto it. After this, the end which has been left open is sealed at another unit with another end member, after which the container is filled through a filling hole in a filling unit and the closing flap is sealed Alternatively, the closing flap can be applied to the end of the container immediately prior to filling the container, and after the filling of the container the closing flap is sealed is such a way that it closes the hole tightly. The filling unit is described in European Patent 479010. International Publication WO 96/41743, on the other hand, presents the method for closing a liquid package filled with contents as described above. The liquid package is closed with a closing flap after the liquid has been introduced into the container through a filling hole in the end member, left open by a closing flap that is attached to the end member at its edge. International Publication WO 96/17772 presents a method in which a container formed by a sidewall blank and a bottom member is filled with contents through an open end, after which the lid member provided with a discharge hole closed with a closing flap is placed on the said end and seamed onto the laterally projecting flange on the upper surface of the end.

European Patent 501987 presents a lid which is either wholly detachable or partly detachable by means of perforation, the edges of which lid are folded downwards and seamed onto the inwards folded top edge of the container. After the lid has been attached, the container can be filled through the bottom, after which the bottom is sealed. The patent also mentions the possibility of filling the container through a filling hole made for the purpose, which is closed after filling by means of a closing flap.

The object of the present invention is to provide a new method for forming a container, which will give new possibilities for transferring the container from the container-forming unit to the filing unit and for filing, sterilizing and sealing the container to form a ready-made aseptically filled container. What is essential is that, after the sidewall blank has been formed from a blank by wrapping, it is closed with a lid member which has already been equipped with a detachable closing element that seals the discharge hole tightly, and the filing is performed through the bottom, which is left open, i.e. the container is in a way upside-down during the filing stage. After this the container is sealed tightly by seaming the bottom member to the sidewall blank.

By virtue of the present invention, the lid member can be produced so that it is equipped with a tightly closed closing element and the lid member can be seamed onto the sidewall blank already in the container-forming unit, and at the filling unit, in connection with the appropriate sterilisation and filling operations, the contents such as liquid foodstuffs will at the filling stage be fed in onto the lid member forming the bottom of the casing. The filling and operational stages preceding and following it are easier to perform through the large open end compared to the situation where the operational stages would have to be performed through a tight discharge hole. The packaging machine need comprise only two units, a container-forming unit where a container left open at one end is formed, and a filling unit where a container can be filled and sealed with another end member. It is unnecessary to have two successive container-forming units as presented in European Patent 456011.

In addition, it is possible to transfer the can which is formed in the container-forming unit on the forming mandrel and which comprises a sidewall blank and a bottom member, from the mandrel in the axial direction, for example pneumatically; along a suitable conveyor track, to the filling unit in such a way that it will enter the filling unit in an upright position with the lid member facing down.

Other preferred embodiments of the present invention will become apparent from the appended claims and the following detailed description.

The object of the present invention will be described in more detail with reference to the attached drawings in which.

In this connection the different parts of the liquid container are called as follows:

Container: a filled container or a casing depending on the context

Package: a ready-made liquid container filled with contents and closed

Casing: an unfilled and unclosed outer sidewall blank of a container

Can: a container, which is characterised in that it has a part that is wrapped to form a structure that is closed in the cross-section perpendicular to the longitudinal axis, i.e., a sidewall blank, one or both ends of which are closed with an end member.

Container blank: a straight, planar part, usually made of liquid packaging board, by joining of which the casing is formed, and which can be separated from a larger piece of material, such as a long strip.

Outer surface of the blank or blank material: a surface, which in the ready-made container forms a surface visible to the outside and which usually has printing and a heat-sealable coating.

Inner surface of the blank or blank material: a surface which in the ready container forms a surface that is in contact with the contents of the container and which usually has a heat sealable coating.

Figure 1:
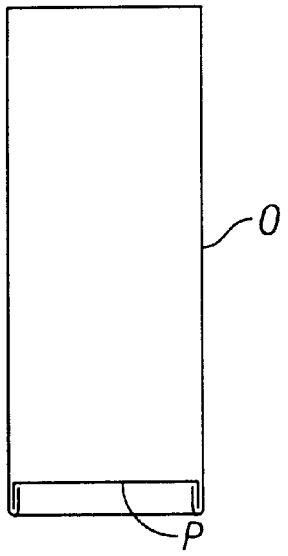
FIG. 1 depicts a longitudinal cross-section of a can forming part of the container formed in accordance with the present invention seen

Blank material: raw material of blanks, usually liquid packaging board coated with a heat sealable coating The packaging machine has a container-forming unit in which the upright part of the can-shaped casing shown in FIG. 1, which in horizontal cross-section has the form of a closed circle, i.e. the sidewall blank O, is formed, into which the lid member P closing the open end of the sidewall blank is inserted. The can-shaped container formed in this way, one end of which is still open, is transferred to the filling unit of the packaging machine, where the final package is formed.

Figure 2:
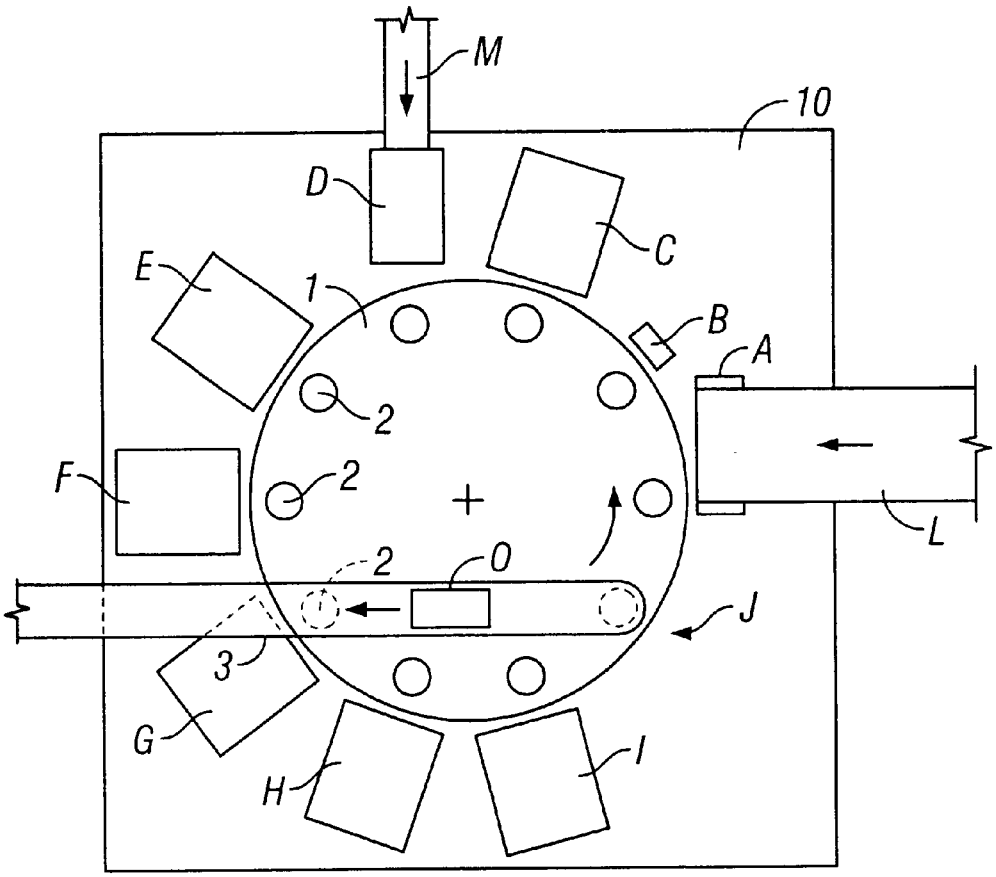
FIG. 2 shows a view of a container-forming unit seen from above

The container-forming unit shown in FIG. 2 has a horizontally revolving transfer table 1, on the circumference of which there are at fixed intervals forming dies that support the above-mentioned container in its various forming stages. The forming dies are identical and are each formed of an upright mandrel 2, around which the sidewall blank of the casing is formed and which will later be called a wrapping mandrel.

The container-forming unit has, in addition to the transfer table 1, a fixed frame on which the table is a arranged to rotate, and which is indicated generally by the reference number 10. The frame is equipped with processing stations, the number of which corresponds to the number of wrapping mandrels 2, and at each of the said stations a certain stage of forming the can, which is left open at one end, is performed. At the halt stage, when the processing stations are performing certain operational stages, the mandrels are at the processing stations, and in the advancement stage they are transferred by a short rotating motion of the table, the length of which corresponds to the angular distance between the wrapping mandrels 2, to the next station for the next processing stage.

In the following, the different processing stations are described in more detail mainly on the basis of their role in forming a can-shaped casing. All the stations incorporate parts fixed on frame 10, which parts with their movement or with another action performed by them, cause the operational stages to be effected. The moving parts are located on the frame, mainly outside the circular track of the wrapping mandrels and/or above the mandrels or they are placed so that they are temporarily located on the track of the mandrels and move out of the mandrels' way for the duration of the advancement stage. These different parts are not shown in FIG. 2 in more detail, but the Figure shows only the supporting structures of the different stations to which the above mentioned functional parts are fixed.

At wrapping station A, a web of a predetermined height is cut off the lower end of blank web L, which has been transferred to the station with the aid of transfer devices located on the frame, and the said web is pushed onto the wrapping mandrel 2 and wrapped around it to the shape defined by the outer surface of the mandrel. As a result, the sidewall blank of a can-shaped casing is formed, the horizontal cross-section of which is a closed shape, in case of cylindrical mandrels a round shape.

At the side sealing station B, the sidewall margins of the web placed to overlap at the wrapping station are finally seamed together. This is performed with the help of a clamping surface which presses the overlapping margins against each other and at the same time the clamping surface causes the heat-seal coating on the inner surface of the blank, which has been heated to the bonding state, to cool.

At the preheating station C, hot air is blown into the top end side of the side-sealed part, which causes the heat-seal coating at this point on the inner surface of the blank material to heat up to a suitable temperature.

An the end member station D, end members P, which correspond in outline to the horizontal section of the sidewall blank, in the case of cylindrical sidewall blanks, round end members, are separated by die cutting from the continuous blank web M fed to the station by a stepwise moving conveyor, after which the parts are forced through the hole with a plunger whereby causing the parts to fold at their outer edges. After this the said part is pressed downwards with the same plunger into the open upper end of the sidewall blank, using the top end of the wrapping mandrel as a counter surface to press the folded up outer edges of the end part against the inner surface of the sidewall blank. These end members are the lid members forming the container and each of the said end member is provided with a discharge hole, which has already been closed with a detachable closing element, such as a separate closing flap that is smaller than the end member and covers the hole, and thus the said discharge holes can already be closed as tightly as required for the use of the container. These discharge holes have also been used as filler holes in state-of-the-art solutions, in which case e.g. the closing flap is partly open during filling and attached to the material around the hole by only one edge.

An the first heating station E, hot air is blown onto the outer surface of the lid member directing it towards the edges, whereby the lower surface of the part situated at the edges folded up towards the inner surface of the upper end of the sidewall blank are heated.

At the second heating station F, the same treatment is performed to ensure adequate heating around the whole perimeter of the upper end.

At the clenching station G, the upper edge of the sidewall blank, which is positioned above the upward folded edge of the lid member, is folded by pressing from above towards the centre and down, whereby the upper edge of the sidewall blank is folded around the upward-folded outer edge of the lid member. This is performed with a suitable forming tool which is pressed in the longitudinal direction of the mandrel towards the end face of the mandrel, and which tool has an annular groove that bends the marginal portion over the edge of the end member.

An the first end sealing station H, the marginal portion of the sidewall blank is pressed against the upwards folded edge of the lid member, at which stage the heat-seal coatings heated at earlier heating stages cause the parts to bond to each other and the lid member's upward-folded outer edge will remain inside the upper edge which is folded into the shape of a U.

At the second end sealing station 1, the same operational stages are performed at different points than at the previous station, in order to ensure an even seam around the whole perimeter of the already final can-shaped casing.

At the last processing station, the container removal station J, the can-shaped casing is lifted off the wrapping mandrel 2, and transferred along the conveyor track 3 to the filling unit of the packaging machine.

When the ready-made can has been removed from the wrapping mandrel 2, the mandrel moves by a short rotating movement of table 1 to the wrapping station A to receive a new blank for the sidewall blank and the above-described processing stages are repeated.

Typical processing times at stations A to J are in the rage of 500 ms, which includes the transfer from one station to the other. This means that a can may be produced completely in a container-forming unit in approx. 5 seconds, and the capacity is 1 can/0.5 s, i.e. about 120/min.

Figure 3:
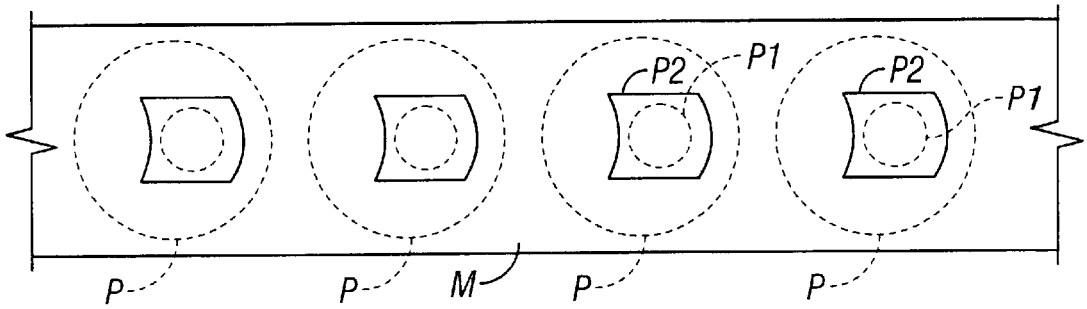
FIG. 3 shows a web strip according to the present invention.

FIG. 3 shows in more detail the continuous blank web M that is fed to the end member station D. The blank web M is made of liquid packaging board, the upper and lower surface of which has a coating suitable for heat sealing. The blank web is narrow, only a little wider than the diameter of the lid member and it is provided with a continuous line of discharge holes P1, each one of which has already been closed with a closing flap P2, a so-called pull-tab, with the help, for example, of the heat-seal materials on the lower surface of the closing flap and the web material. The closing flap P2 is attached at all its edges to the upper surface of the lid member around the discharge hole P1. The discharge hole may be provided with a reinforcing edge formed in a known way. The closing flap 2 may be of a material that is suitably tight, for example, of aluminum film or of a laminate. The closing flaps 2 are located parallel to each other on the blank web, in such a way that their longitudinal direction is the same and the said closing flaps can be cut from a longer strip of closing flaps in connection with the production of the blank web and they can be attended automatically to the upper surface of the web after the holes have been formed. The lid members P marked by broken lines can be die cut from the blank web M, and at the same station an axial edge can be formed on the said members, i.e. in the longitudinal direction of the can, by forcing the said members through the opening. The web is provided with printed marks (not shown) that allow the web to be positioned correctly on the web conveyor exactly at the die cutter in station D.

Figure 4:
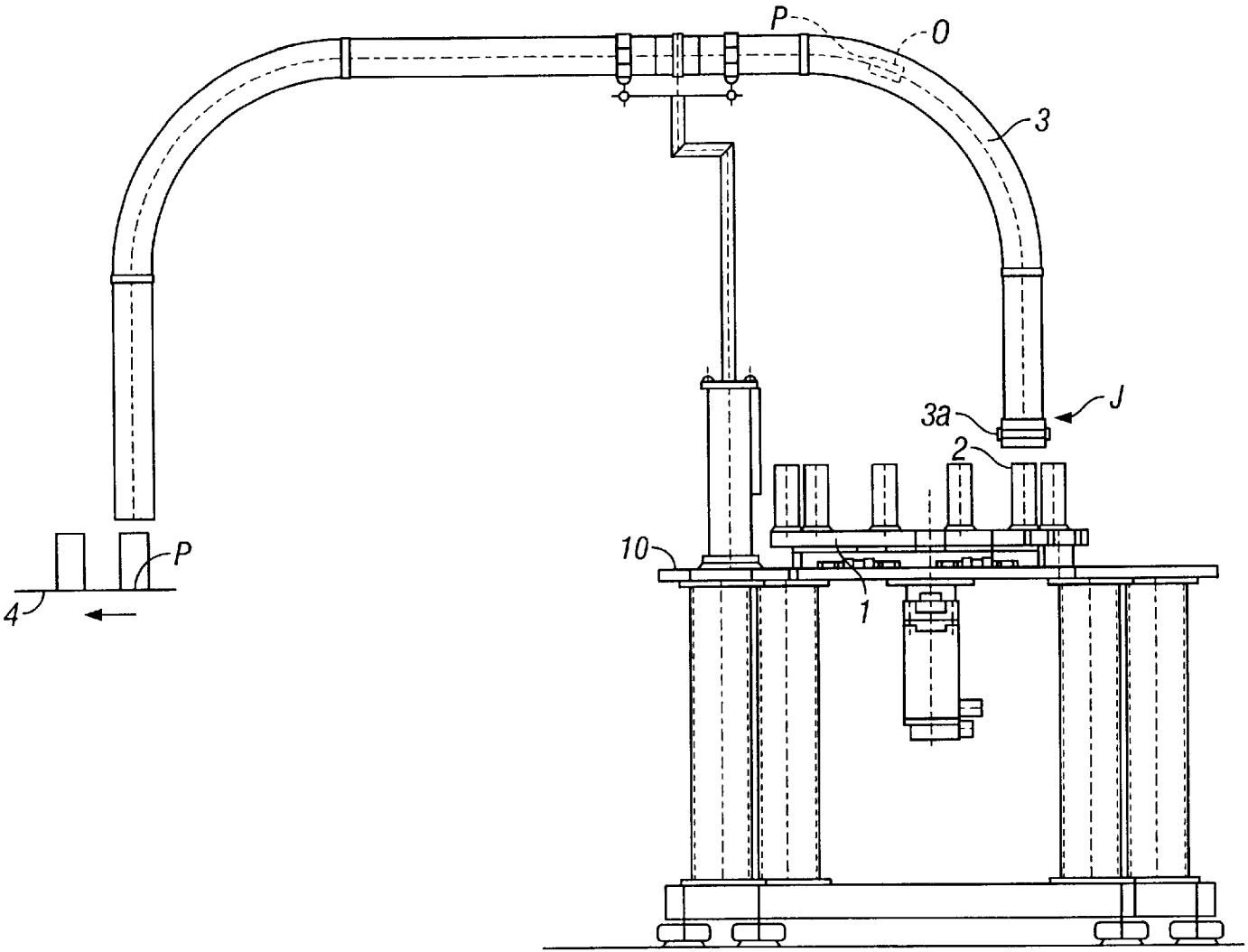
FIG. 4 shows a conveyor track between the container-forming unit and the filling unit.

FIG. 4 shows a schematic view of the transfer to the filling unit of a casing of can-like shape formed in the container-forming unit. The can is moved off the wrapping mandrel 2 that has arrived at the container removal station J by ejecting it in an axial direction, i.e. in the longitudinal direction of the mandrel, off the mandrel with the help, for example of air impingement from inside the mandrel. The can moves along the conveyor track 3 in an axial direction falling onto the conveyor 4 of the filling unit in such a way that the lid member faces down and the other end, the end of the sidewall blank which is left open, faces up. The casings move in succession on the conveyor track with the lid members P in front, at intervals determined by the production speed of the container-forming unit. Since the wrapping mandrels 2 are in an upright position in the container-forming unit, the conveyor track must be roughly the shape of an upside-down U so as to enable the can to turn 180° during a transfer movement in axial direction. The conveyor track 3 is realised in the form of a pneumatic transfer tube into the beginning of which compressed air has been introduced through an air passage, whereby this connection forms an annular ejector structure 3*a,* the airflow of which coming into the tube in the direction of transfer at the same time sucks the can falling from the mandrel into the tube and moves it forward in the tube.

Figure 5:
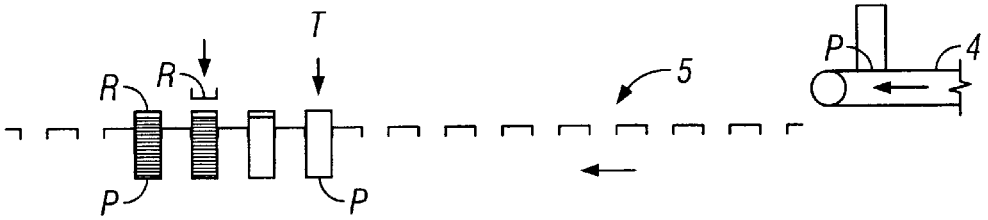
FIG. 5 shows operational stages of the filling unit.

FIG. 5 shows a filling and sterilisation line. The conveyor 4 of the filling unit feeds the cans falling continuously off the conveyor track 3 on to the filling unit's filling and sterilisation line 5, which means that between the conveyor receiving the cans and the filling and sterilisation line, there may be a device for guiding the cans in order to place them on this line into holders or similar spaces, which place the cans accurately without changing their upright position. The device may be e.g. a distribution device that divides the cans coming from the conveyor into several parallel filling and sterilisation lines, or the distribution can be performed by making the pneumatic transfer pipe a two-part pipe, wherein the transfer point is in the horizontal portion. The first part of the pneumatic transfer pipe revolves in such a way that it distributes cans to the fixed-station pipes of the end of the pneumatic transfer pipe in the appropriate order by always meeting one of the end pipes in the horizontal portion of transfer line 3. The end parts of the pipes are side by side in connection with the conveyor 4.

In the filing and sterilization line 5, the cans move in succession going through different stations one after another, where appropriate sterilization and filing is performed, which may be of the kind known in the prior art in the food industry. FIG. 5 shows mainly the filing station T, where the can is filled with contents, e.g. with liquid introduced into the can through a portioning nozzle located above the can. After this there is possibly a foam removal station and the sealing station, where the open upper end through which the filling has been performed, is closed with the bottom member R forming the bottom of the final single-portion package. When the can is at this station an oxygen-free protective gas, e.g. nitrogen, will also be introduced into the can above the surface of its contents. Immediately after this the bottom member R, the edge area of which is already folded upwards, will be introduced through the upper end of the can into the can according to the same principle as the lid member P was introduced in the container-forming unit through the end of the sidewall blank O located on the mandrel. Prior to this, the inside of the bottom member R has been sterilized appropriately, i.e. the side that remains inside the container. The bottom member R is intact, i.e. it does not have an opening. the bottom member R has been sterilised appropriately, i.e. the side that remains inside the container. The bottom member R is intact, i.e. it does not have an opening.

After the sealing station the container moves along the line to the seaming stages, which include the preheating of the parts of the bottom member and the sidewall blank that are seamed together, the folding inwards of the marginal portion of the sidewall blank O around the edge of the bottom member R that has been folded in the axial direction; and the clamping of this folded marginal portion around the edge of the bottom member R.

After the line, the container is ready and it can be transferred e.g. to further packaging, where a collating package comprising several containers is formed, which is ready for dispatch.

The sidewall blank O is wrapped onto the outer surface of the wrapping mandrel 2 preferably by using suction produced from the inside of the wrapping mandrel through the holes in the side surfaces of the wrapping mandrel at wrapping station A. The suction, with the help of wrapping aids, possibly acting from outside the mandrel, makes it possible to pull the blank pressed onto the mandrel around the mandrel and pull the preheated side edges of the blank on top of each other to form a side seam. The present invention is not, however, limited to this particular method of forming a sidewall blank.

Figure 6:
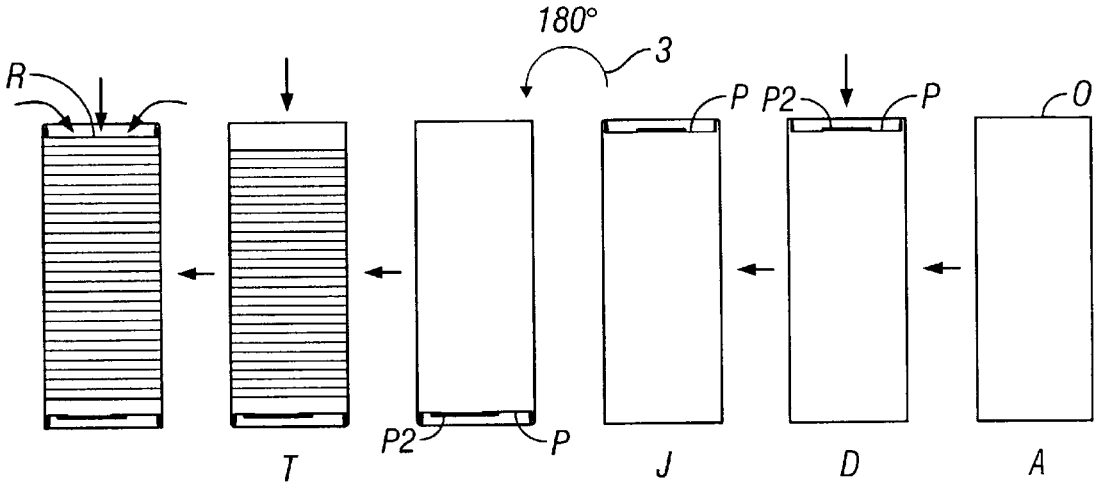
FIG. 6 shows in outline a schematic view of the different stages of forming a single-portion package according to the present invention.

FIG. 6 shows in summarized form all the container forming and processing stages described above by depicting the forming of the container and its position during the different stages, beginning with the formation of the sidewall blank and the fitting of the lid member into it and finishing with the ready filled container.

Figure 7:
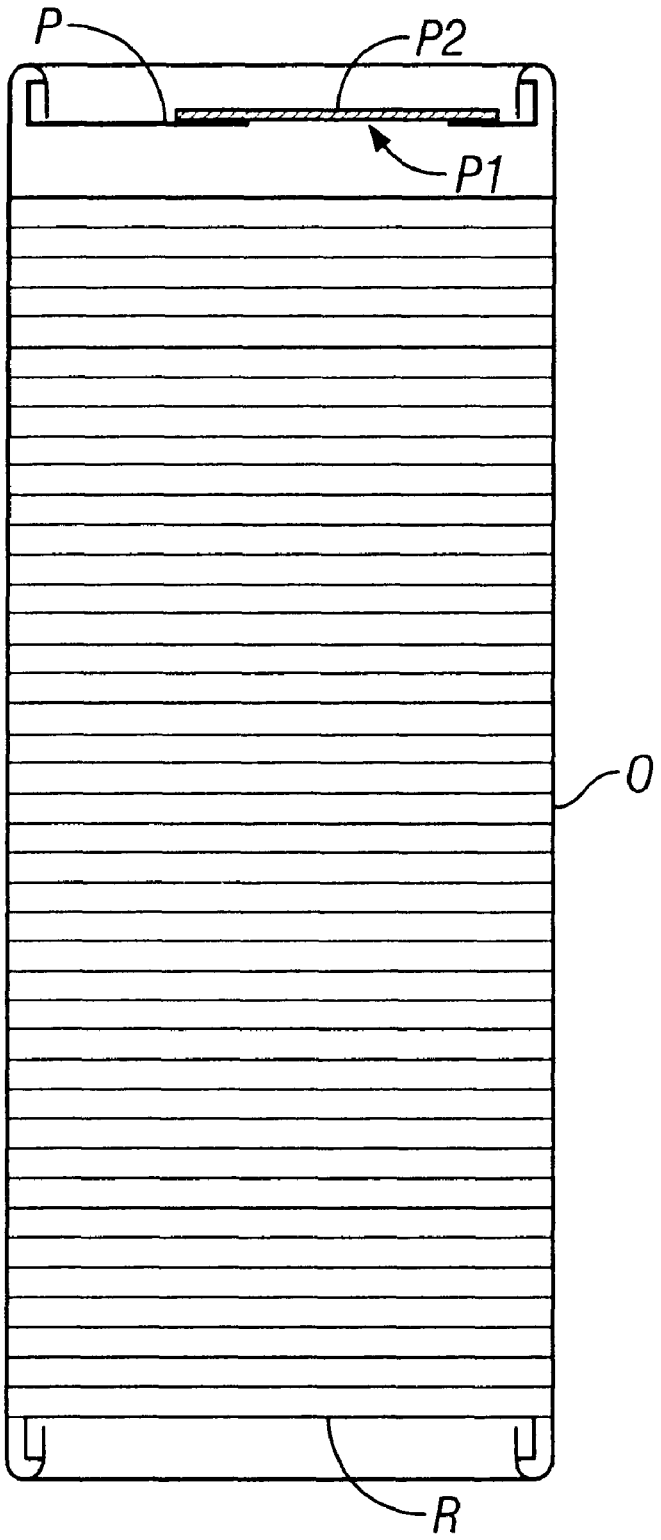
FIG. 7 shows a ready-made container produced according to the present invention.

FIG. 7 shows the container in its usual position in retail outlets and the position in which it is used, i.e. the lid member P inserted in the container-forming unit and the closing flap P2, which is on the surface of the said lid member, are facing up.

Even though the figure does not give exact measurements, the container is slightly and barely perceptibly upward-tapering, i.e. cone-shaped in such a way that the sidewall blank O is narrower at the level of the lid member P than at the level of the bottom member R, which is due to the fact that the forming mandrel 2 is slightly sloping in order to easily release the can, the cap member of which is on the end face of the mandrel and the sidewall blank of which is held relatively tightly against the side surface of the wrapping mandrel, from the mandrel by means of e.g. air impingement. The air impingement can be introduced from the end of the mandrel. To ensure the release of the can, air can be introduced at the same time through the holes of the side surface of the mandrel, which have been used as described above to wrap the blank around the mandrel. The conical shape, i.e. the width difference of the almost cylindrical containers is 2 mm at the most, e.g. between 0.2 and 1.0 mm per 100 mm in height.

Instead of the approximately cylindrical container, round in horizontal section, shown in FIG. 7, containers which are more conical than the measurements given above, e.g. visibly cone-shaped containers, can also be formed. Likewise, the cross-section of the sidewall blank O defined by the form of the side surface of the wrapping mandrel 2 may also be other than round. In addition, the proportions of the container are usually such that the distance between the bottom and the end member (the height) exceeds the average diameter of the sidewall blank.

In the prior art there are also known methods of forming the casing, in which the sidewall blank is wrapped around the mandrel only after the end member has been placed on the end of the mandrel, whereby the upper end of the sidewall blank is wrapped simultaneously around the axial edge of the end member. The following further stages of the forming and the filling of the container may be the same as those described above.

The present invention is particularly suitable for the liquid containers used by the food industry, e.g. for various containers containing different beverages, examples of which are juice containers. The container can in principle have any capacity, but it is usually 1.5 to 5.0 dl in case of beverage containers, but also bigger containers with a capacity of over 1 liter are possible. The material for the container's sidewall blank O as well as the cap and bottom members P and R may be generally known liquid packaging boards, coated with heat-seal plastic.

What is claimed is:

1. A container comprising:

a sidewall blank closed in its horizontal section and shaped as an upwardly tapering cone;

a lid member, wherein the lid member includes a discharge whole and a openable closing member, the lid member having edges folded in a longitudinal direction of the sidewall blank; and a bottom member, wherein the bottom member has edges folded in a longitudinal direction of the sidewall blank, wherein the lid member and bottom member are inside the sidewall blank and edges of the side wall blank are folded inwardly over edges of the lid member and bottom member, to form a seam effective for sealing the container.

* * * * *